US009080509B2

(12) United States Patent
Huberts et al.

(10) Patent No.: US 9,080,509 B2
(45) Date of Patent: Jul. 14, 2015

(54) SYSTEM AND METHOD FOR MONITORING AN IGNITION SYSTEM

(75) Inventors: Garlan J. Huberts, Milford, MI (US); Qiuping Qu, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 771 days.

(21) Appl. No.: 13/371,170

(22) Filed: Feb. 10, 2012

(65) Prior Publication Data

US 2013/0206106 A1 Aug. 15, 2013

(51) Int. Cl.

*F02P 11/06* (2006.01)
*F02B 77/08* (2006.01)
*F02P 17/12* (2006.01)

(52) U.S. Cl.

CPC ..... *F02B 77/08* (2013.01); *F02P 11/06* (2013.01); *F02P 17/12* (2013.01); *F02P 2017/125* (2013.01)

(58) Field of Classification Search

CPC ..... F02P 2017/121; F02P 2017/123; F02P 2017/125; F02P 11/06; F02P 17/12; H01T 13/58; H01T 13/60

USPC ..... 123/406.13, 406.14, 630, 644, 655; 73/114.08, 114.62, 114, 67, 114.77

See application file for complete search history.

(56) References Cited

U.S. PATENT DOCUMENTS

| | | | | |
|---|---|---|---|---|
| 2,188,845 | A | 1/1940 | Ramsay | |
| 4,349,782 | A | 9/1982 | Doss | |
| 4,547,734 | A | 10/1985 | Spaude | |
| 5,156,127 | A * | 10/1992 | Ghaem | 123/406.13 |
| 5,269,282 | A | 12/1993 | Miyata et al. | |
| 5,283,527 | A * | 2/1994 | DeBiasi | 324/391 |
| 5,751,147 | A * | 5/1998 | Nakata et al. | 324/399 |
| 6,222,368 | B1 * | 4/2001 | Inagaki et al. | 324/399 |
| 6,512,375 | B1 * | 1/2003 | Yamada et al. | 324/399 |
| 6,734,677 | B2 * | 5/2004 | Toriyama et al. | 324/399 |
| 6,920,783 | B2 * | 7/2005 | Kesler | 73/114.08 |
| 7,124,019 | B2 | 10/2006 | Goodell et al. | |
| 2001/0039941 | A1 * | 11/2001 | Yamada et al. | 123/406.14 |
| 2002/0196024 | A1 * | 12/2002 | Peterson et al. | 324/399 |
| 2003/0197511 | A1 | 10/2003 | Takahashi et al. | |
| 2004/0085070 | A1 * | 5/2004 | Daniels et al. | 324/391 |
| 2010/0057324 | A1 * | 3/2010 | Glugla et al. | 701/102 |
| 2010/0206276 | A1 | 8/2010 | Deloraine et al. | |
| 2011/0041803 | A1 * | 2/2011 | Qu et al. | 123/406.2 |
| 2013/0099792 | A1 * | 4/2013 | Patti et al. | 324/399 |

* cited by examiner

*Primary Examiner* — Erick Solis
(74) *Attorney, Agent, or Firm* — Julia Voutyras; Alleman Hall McCoy Russell & Tuttle LLP

(57) ABSTRACT

A system for monitoring and cleaning a spark plug is disclosed. In one example, an amount of carbonaceous soot at the center electrode ceramic of the spark plug is determined in response to a voltage of a sense resistor that is in electrical communication with the spark plug. The system may institute spark plug cleaning after carbonaceous soot is detected so that the possibility of engine misfire may be reduced.

18 Claims, 6 Drawing Sheets

SYSTEM AND METHOD FOR MONITORING AN IGNITION SYSTEM

FIELD

The present description relates to a system for monitoring operation of an ignition system of a spark ignited engine. The system may be particularly useful for determining when to activate a spark plug soot removal mode.

BACKGROUND AND SUMMARY

Cold starting an engine at lower ambient temperatures may be improved by enriching an air-fuel mixture supplied to an engine cylinder. Increasing the amount of fuel injected to a cylinder can increase an amount of fuel that vaporizes in the cylinder so that the air-fuel mixture in the cylinder may be ignited. However, the additional fuel may also cause soot or conductive deposits including liquid fuel to form on the ceramic of the center electrode at a spark plug in the cylinder, thereby shunting the spark gap and reducing the possibility of creating a spark within the cylinder. Therefore, it may be desirable to determine whether or not soot is forming on a spark plug.

One way to ascertain whether or not soot is forming on a spark plug is to monitor engine operation for misfires. Engine misfires may be determined from changes in engine speed. However, engine emissions can degrade in the presence of engine misfires. For example, engine hydrocarbon emissions can increase due to engine misfires. Consequently, determining whether or not spark plugs are laden with soot via detected engine misfires is not as desirable as detecting spark plug soot without the engine having to misfire.

The inventors herein have recognized the above-mentioned disadvantages and have developed a system for monitoring a spark plug, comprising: an ignition coil including primary and secondary coils; a spark plug in electrical communication with the secondary coil; a sense resistor electrically coupled in series with the secondary coil and spark plug; and a controller including instructions stored in non-transitory memory to adjust operation of an engine responsive to an electrical characteristic of the sense resistor during an ignition dwell period.

By monitoring voltage or current of a sense resistor during an ignition dwell period, it may be possible to determine an amount of carbonaceous soot or other conductive deposits that may be present on the center electrode ceramic of a spark plug. Further, soot accumulation may be determined before engine misfire occurs because the voltage across the sense resistor is indicative of even small amounts of accumulated soot. Therefore, soot accumulation may be determined before an engine misfire occurs. In one example, a voltage across a sense resistor is driven more negative during an ignition dwell period as an amount of carbonaceous soot deposited to a spark plug center electrode ceramic increases. The system attempts to remove the carbonaceous soot from the spark plug electrode by increasing temperature and pressure in the cylinder in which the spark plug supplies spark.

The present description may provide several advantages. In particular, the approach detects carbonaceous soot deposits in a way that does not require an engine misfire to occur. Thus, the approach may improve engine emissions by taking actions to remove carbonaceous soot from a spark plug before engine misfire is detected. In addition, provides an indication of spark duration so that engine misfires may be determined. Further, by removing soot before a misfire caused by soot occurs, engine emissions may be reduced.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
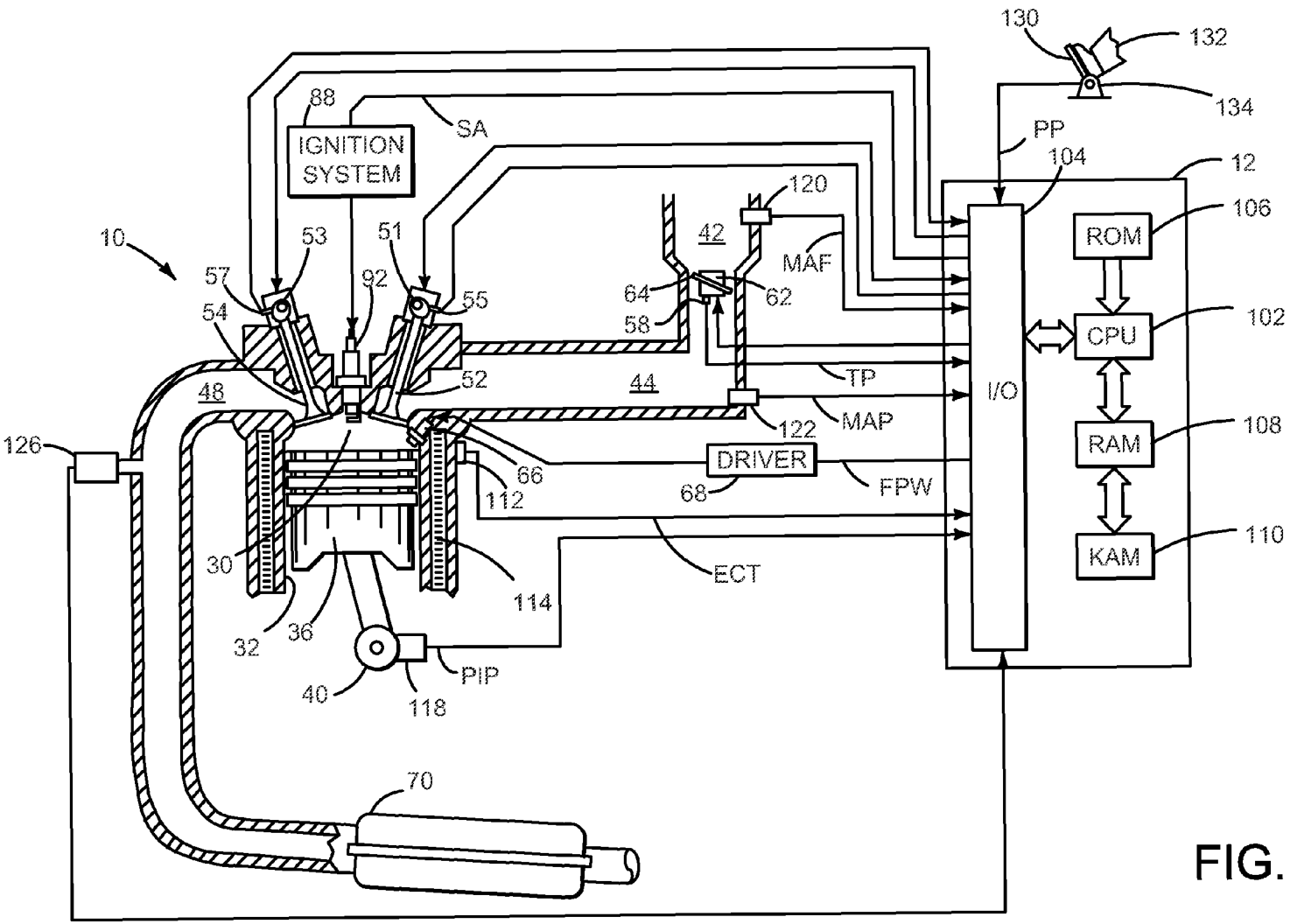
FIG. 1 is a schematic diagram of an engine.
Figure 2:
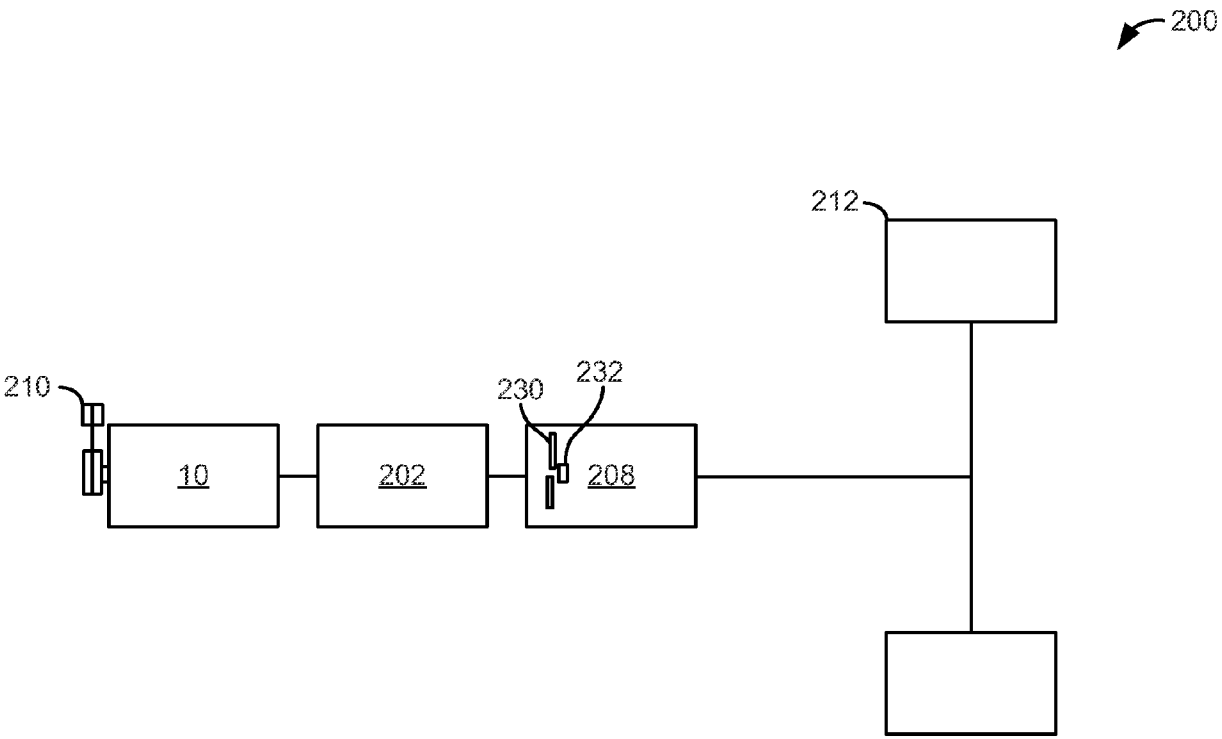
FIG. 2 is a schematic diagram of a vehicle which the engine propels.
Figure 4:
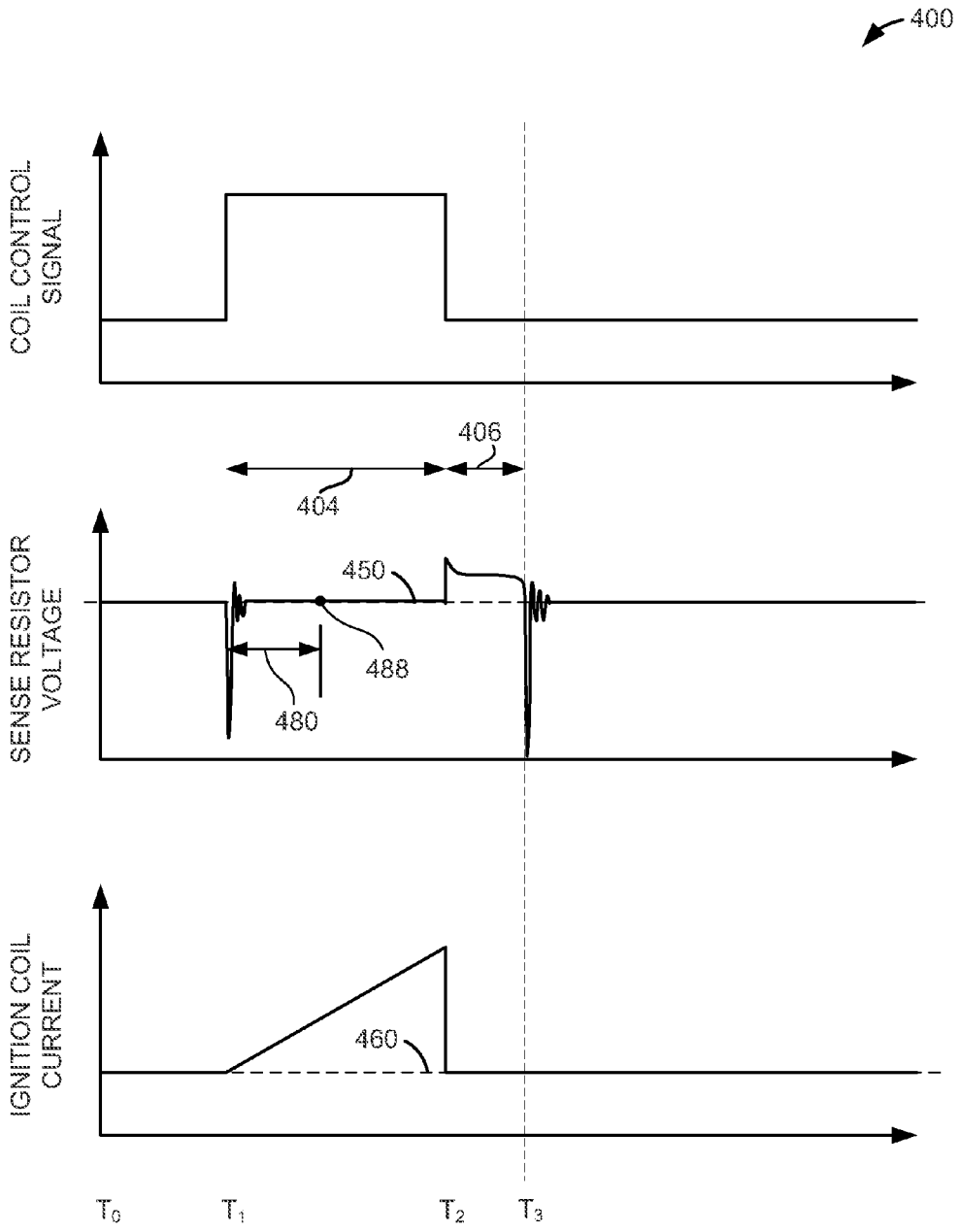
FIG. 4 is an example plot of signals of interest during a cycle of a cylinder where a low amount of carbonaceous soot is at a spark plug center electrode ceramic.
Figure 5:
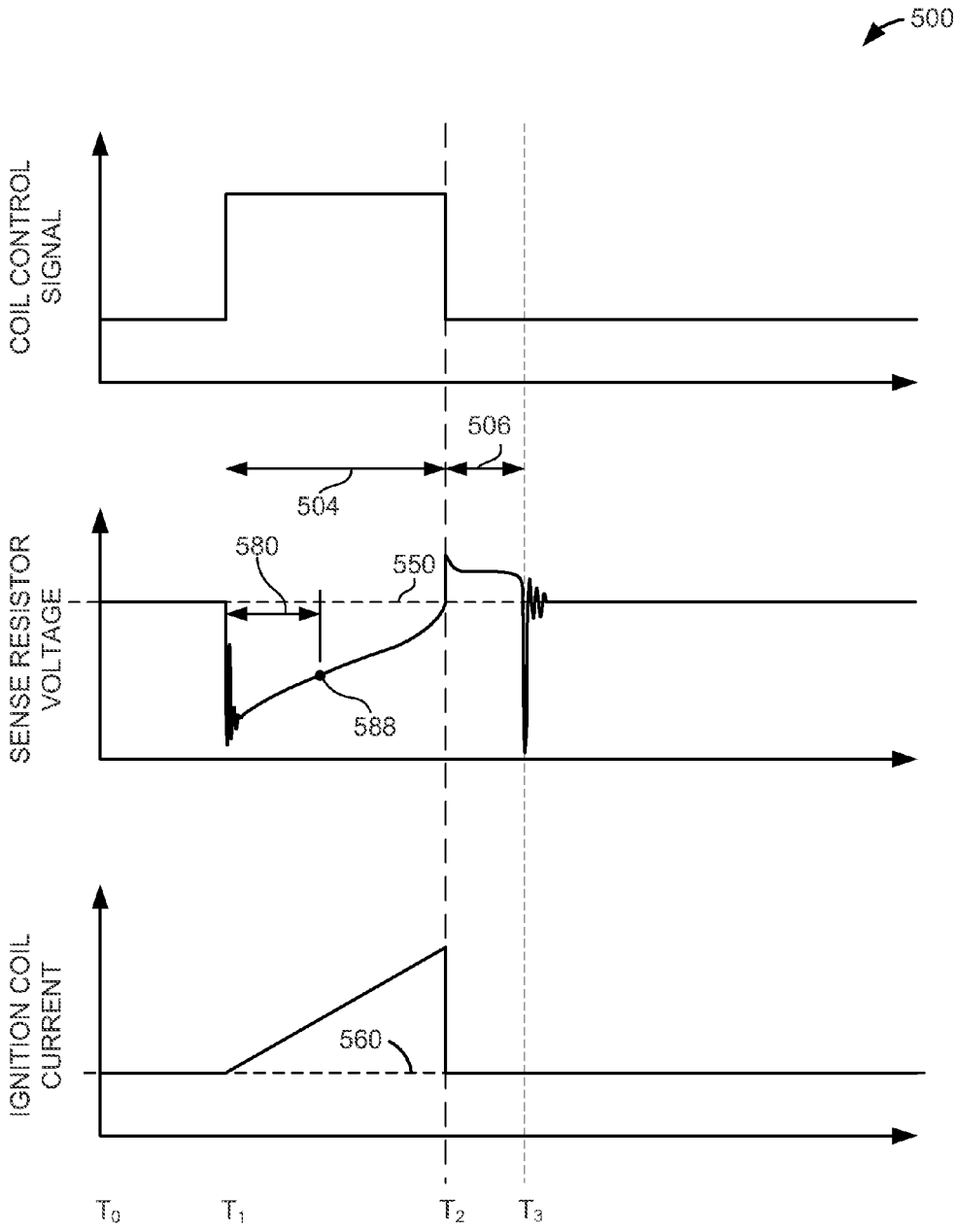
FIG. 5 is another example plot of signals of interest during a cycle of a cylinder where a greater amount of carbonaceous soot is at a spark plug center electrode ceramic.

The present description is related to detecting and removing carbonaceous soot from a spark plug of a spark ignited engine. In one non-limiting example, the engine may be configured as illustrated in FIGS. 1 and 2. Carbonaceous soot and/or conductive deposits may be detected during engine operation via the circuit shown in FIG. 3. In one example, detection of carbonaceous soot and/or conductive deposits is based on a voltage at a sense resistor during an ignition dwell period as illustrated in FIGS. 4 and 5. The method of FIG. 6 includes detecting carbonaceous soot and/or conductive deposits accumulated on the spark plug center electrode ceramic and adjusting engine operation to remove the soot when it is detected.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 which responds to controller 12. In addition, intake manifold 44 is shown communicating with optional electronic throttle 62 which adjusts a position of throttle plate 64 to control air flow from air intake 42 to intake manifold 44.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some embodiments, the engine may be coupled to an electric motor/battery system in a hybrid vehicle. The hybrid vehicle may have a parallel configuration, series configuration, or variation or combinations thereof. Further, in some embodiments, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

FIG. 2 is a schematic diagram of a vehicle drive-train 200. Drive-train 200 may be powered by engine 10 or electric motor 202. Engine 10 may be mechanically coupled to alternator 210, electric motor 202, and transmission 208. Engine torque may be transmitted to vehicle wheels 212.

Load may be applied to the engine 10 by alternator 210, electric motor/generator 202, and transmission 208. Each of the alternator 210, electric motor 202, and transmission 208, may be adjusted via adjusting control variables of the respective devices. For example, field current of electric motor/generator 202 may be increased or decreased to increase or decrease a load electric motor/generator 202 applies to engine 10. Similarly, a field current of alternator 210 may be adjusted to increase a load applied to engine 10. Additionally, gears 230-232 of transmission 208 may be shifted to increase or decrease a load applied to engine 10.

Figure 3:
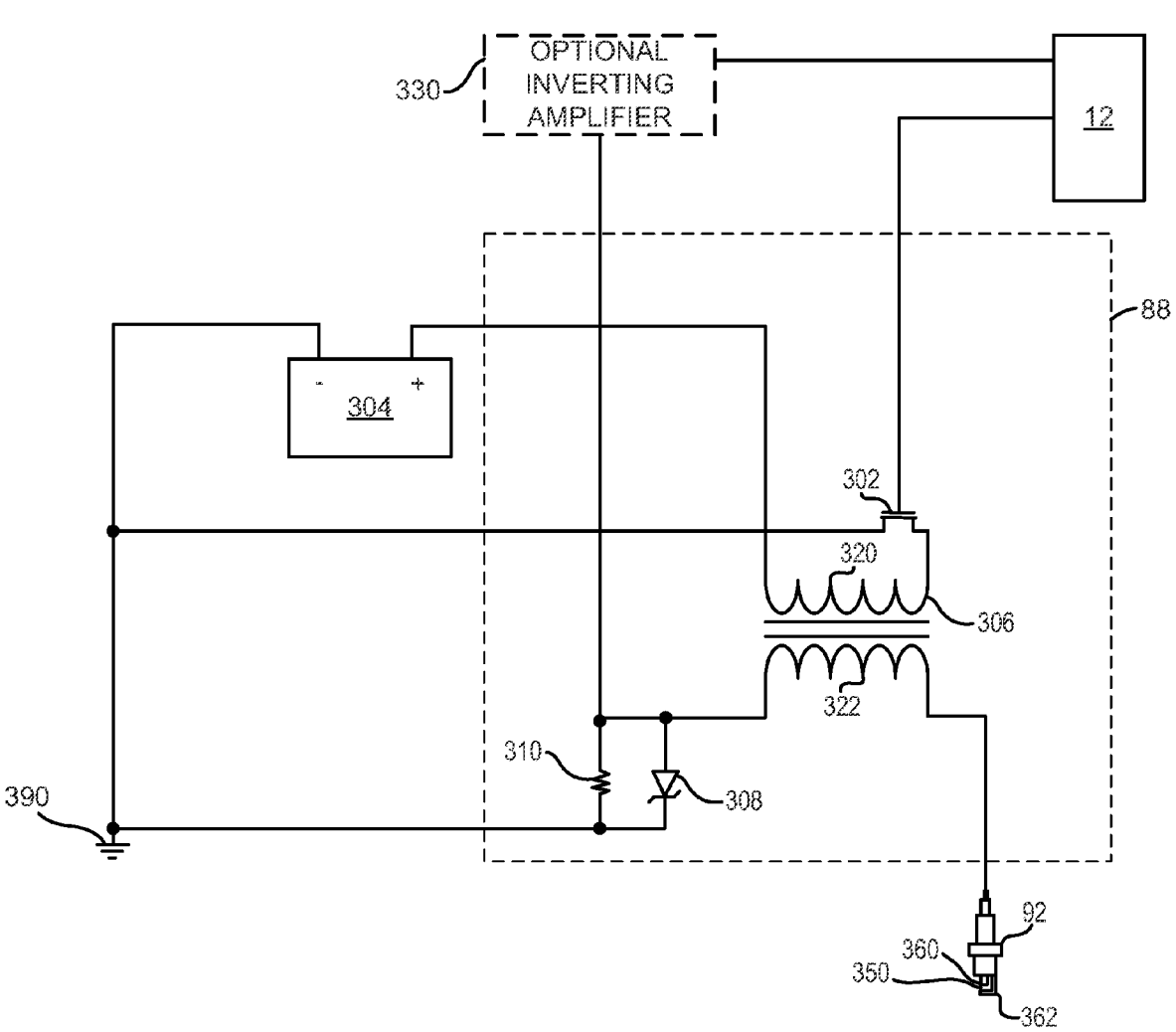
FIG. 3 shows an example circuit for detecting carbonaceous soot formation a spark plug center electrode ceramic.

Referring now to FIG. 3, an example circuit for detecting carbonaceous soot formation at a spark plug's center electrode ceramic is shown. The circuit of FIG. 3 may be included in the system of FIGS. 1 and 2.

Battery 304 supplies electrical power to ignition system 88 and controller 12. Controller 12 operates switch 302 to charge and discharge ignition coil 306. Ignition coil 306 includes primary coil 320 and secondary coil 322. Ignition coil 306 charges when switch 302 closes to allow current to flow from battery 304 to ignition coil 306. Ignition coil 306 discharges when switch 302 opens after current has been flowing to ignition coil 306.

Secondary coil 322 supplies energy to spark plug 92. Spark plug 92 generates a spark when voltage across electrode gap 350 is sufficient to cause current to flow across electrode gap 350. Spark plug includes center electrode 360 and a side electrode 362. Voltage is supplied to center electrode 360 via secondary coil 322. Side electrode 362 is electrically coupled to ground 390. Sense resistor 310 is electrically coupled in series with spark plug 92 through secondary coil 322. Zener diode 308 is electrically coupled in parallel with sense resistor 310. Zener diode 308 is reverse biased when ignition coil 306 charges and is forward biased to ground 390 during the spark.

A voltage develops across sense resistor 310 when current flows into primary coil and a field develops within ignition coil 306. The voltage that develops is dependent on an amount of carbonaceous soot deposited on the center electrode ceramic of spark plug 92. In particular, as the amount of soot increases, the absolute value of the amplitude of the voltage increases relative to ground.

Voltage across sense resistor 310 may be provided to optional amplifier 330 which inverts sense resistor voltages shown in FIGS. 4 and 5. In this way, the voltages shown may be converted to positive voltages. Further, the present example shows a negative firing ignition coil. However, the circuitry is also applicable to a positive firing ignition coil, but the polarity of zener diode 308 is reversed and the sensed voltage across sense resistor 310 is reversed.

Thus, the system of FIGS. 1-3 provides for monitoring a spark plug, comprising: an ignition coil including primary and secondary coils; a spark plug in electrical communication with the secondary coil; a sense resistor electrically coupled in series with the secondary coil and the spark plug; and a controller including instructions stored in non-transitory memory to adjust operation of an engine responsive to an electrical characteristic of the sense resistor during an ignition dwell period.

The system also includes where the adjusting operation of the engine includes adjusting an air-fuel mixture of the engine, and where the ignition coil is a positively or negatively firing ignition coil. The system further includes where the adjusting operation of the engine includes increasing a load applied to the engine, where the electrical characteristic of the sense resistor is a voltage across the sense resistor, and where the voltage of the sense resistor is inverted. The system further comprises a diode arranged electrically in parallel with the sense resistor and in electrical communication with the sense resistor and the secondary coil. The system also includes where the diode is a zener diode, and where operation of the engine is adjusted in response to a voltage across the sense resistor less than a threshold voltage. In some examples, the system includes where the electrical characteristic is a voltage. The system further comprises additional instructions stored in the non-transitory memory to charge the primary coil, and where the ignition dwell period is during charging of the primary coil.

The system of FIGS. 1-3 also provides for monitoring a spark plug, comprising: an ignition coil including primary and secondary coils; a spark plug in electrical communication with the secondary coil; a sense resistor electrically coupled in series with the secondary coil and spark plug; and a controller including instructions stored in non-transitory memory to adjust operation of an engine in response to an electrical characteristic of the sense resistor during an ignition dwell period, and further instructions to adjust operation of the engine in response to a spark duration that is based on the electrical characteristic after the ignition dwell period.

The system also includes where the adjusting operation of the engine in response to the spark duration includes adjusting a cylinder air-fuel ratio. The system includes where the electrical characteristic is a voltage across the sense resistor, and further comprising a diode coupled electrically in parallel with the sense resistor. The system includes where the sense resistor and the diode are electrically coupled to a ground reference, and where the diode is forward biased in a direction of the ground reference during spark. The system also includes where the spark plug and the sense resistor are electrically coupled to opposite ends of the secondary coil. The system also includes where the spark duration is a time from when current flow to the primary coil ceases to a time when the electrical characteristic of the sense resistor after the ignition dwell period switches from a positive value to a negative value.

Figure 6:
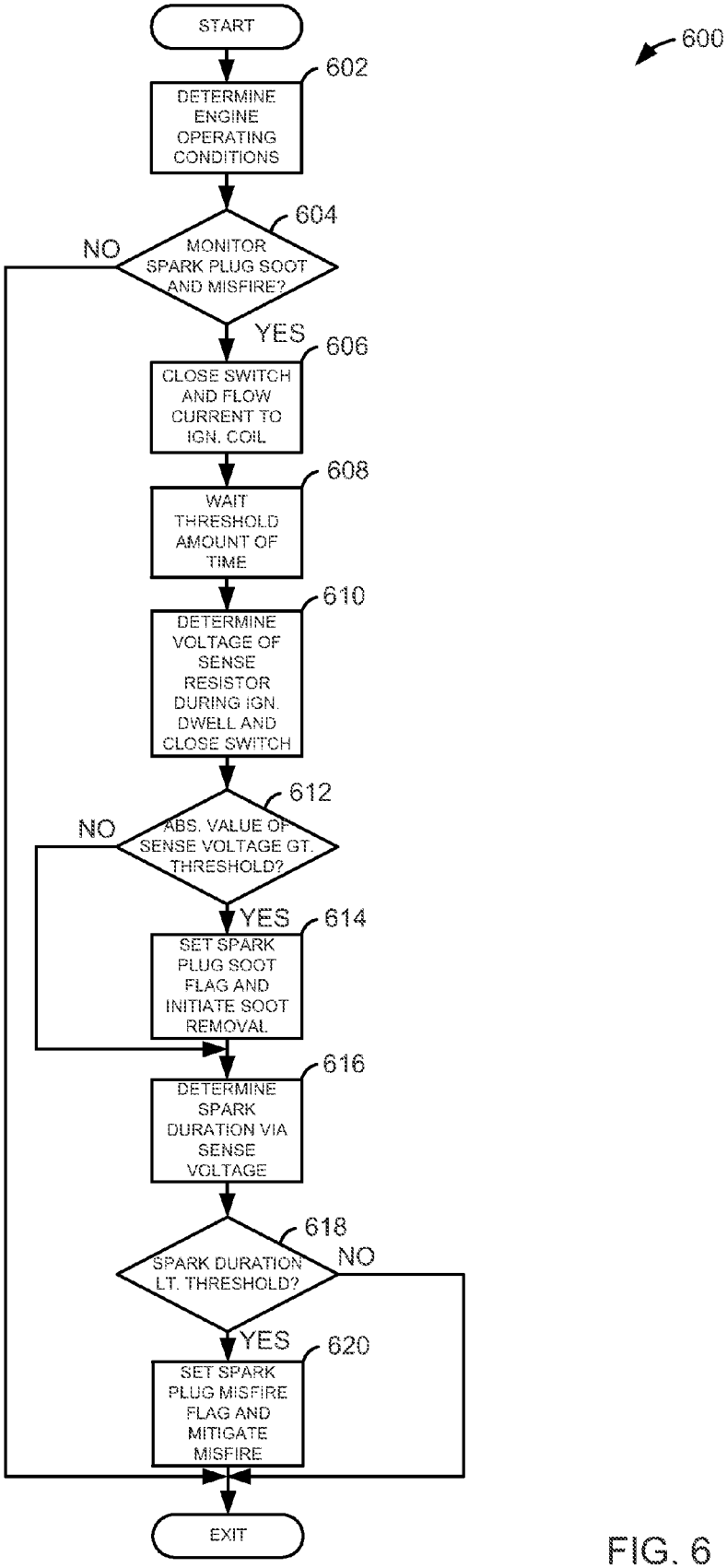
FIG. 6 is a flow chart of an example method for detecting carbonaceous soot at a spark plug center electrode ceramic and taking mitigating actions.

Referring now to FIGS. 4, 5 and 6, an example of simulated signals of interest during a cycle of a cylinder is shown. In particular, the signals of FIG. 4 represent signals related to determining soot accumulation at the spark plug center electrode ceramic. The sequence occurs during a compression stroke of a cylinder. In this example, an amount of soot at deposited on spark plug electrode ceramic is low. The signals of FIG. 4 may be provided via the method of FIG. 6 in the system of FIGS. 1 and 2. Vertical markers $T_0$-$T_3$ represent times of interest between the three plots. Events between the three plots that align with the vertical marks occur at substantially the same time.

The first plot from the top of FIG. 4 is an ignition coil control signal. Current flows into an ignition coil from a battery or alternator when the signal is at a higher level. Current does not flow from the battery or alternator to the ignition coil when the signal is at a lower level. The X axis represents time and time increases from left to right.

The second plot from the top of FIG. 4 represents a voltage that develops across a sense resistor that is electrically coupled to a secondary ignition coil as shown in FIG. 3. Horizontal line 450 represents ground reference level. Voltages above horizontal line 450 are positive, and voltages below horizontal line 450 are negative. Voltage in the positive direction increases in magnitude in the direction of the Y axis arrow. Voltage in the negative direction increases in magnitude in the direction opposite the Y axis arrow. The X axis represents time and time increases from left to right.

The third plot from the top of FIG. 4 represents current flow into a primary coil of an ignition coil. Horizontal line 460 represents a level of zero current flow. Current amount increases in the direction of the Y axis arrow. The X axis represents time and time increases from left to right.

At time $T_0$, the coil control signal as well as the sense resistor voltage and the ignition coil current are static. The coil control signal is at a lower level indicating that current flow into the ignition coil primary coil is inhibited as indicated by the ignition coil current being shown at substantially zero. The voltage across the sense resistor is also at a low level.

At time $T_1$, the coil control signal is asserted as indicated by the coil control signal transitioning to a higher level. Current begins to flow into the primary coil of the ignition coil as indicated in the third plot. The voltage across the sense resistor briefly goes negative and then rings a small amount before returning to ground level. The voltage stays near ground as time extends from time $T_1$.

At time $T_2$, the coil control signal transitions back to a lower level indicating that current flow to the primary coil ceases. The ignition coil current transitions back to substantially zero after having ramped up to an elevated level. The sense resistor voltage is also shown increasing as a magnetic field within the ignition coil collapses, thereby inducing a higher voltage in the secondary coil of the ignition coil and causing a spark to jump across an air gap of a spark plug. The sense resistor voltage remains higher until time $T_3$, where the secondary coil no longer has enough energy to sustain spark current and the spark extinguishes.

The time between time $T_1$ and time $T_2$ is the dwell time 404 or time to charge the ignition coil. The dwell time may be measured from the time when the coil control signal is asserted and current begins to flow into the primary side of the ignition coil to the time when the coil control signal is not asserted and when current flow into the primary coil ceases.

The time between time $T_2$ and time $T_3$ is the spark duration. The spark duration 406 may be determined via measuring an amount of time from when current flow to the primary coil ceases until the time when the voltage across the sense resistor changes from positive to negative after current flow to the primary coil ceases.

Thus, when there is little soot deposited on the spark plug center electrode ceramic, the voltage across the sense resistor is relatively low with respect to ground throughout most of the dwell period. In one example, the voltage across the sense resistor may be sampled at evenly spaced time intervals and the voltages measured at each of the intervals may be summed and divided by the number of samples to provide an average voltage across the sense resistor during the ignition dwell period. For example, the voltage across the sense resistor may be sampled 100 times in the dwell time interval. The voltages measured at each sample are added and the sum is divided by 100 to provide an average voltage across the sense resistor. In other examples, the voltage across the sense resistor may be sampled at a predetermined time beginning from the time when the primary ignition coil begins to charge to determine the voltage across the sense resistor. For example, as shown in FIG. 4, predetermined time duration 480 extends from time $T_1$, where charging of the primary coil starts, to where a voltage across the sense resistor is sampled. The voltage across the sense resistor at the time of sampling is indicated by the dot at 488.

Referring now to FIG. 5, an example of simulated signals of interest during a cycle of a cylinder is shown. The signals of FIG. 5 are similar to the signals described in FIG. 4. Therefore, for the sake of brevity, repletion of the description of common elements is eliminated and differences in the signals and sequence are described with regard to FIG. 5. In this example, an amount of soot formed at the spark plug center electrode ceramic is higher than the amount accumulated in the example of FIG. 4. The signals of FIG. 5 may be provided via the method of FIG. 6 in the system of FIGS. 1 and 2.

At time $T_1$, the ignition coil control signal transitions to a higher level indicating that current begins to flow to the primary coil of the ignition coil. The ignition coil current begins to increase above the zero current level 560 as shown in the third plot from the top of FIG. 5. The voltage across the sense resistor during the dwell period 504 decreases to less than horizontal marker 550 which represents the ground reference. The voltage across the sense resistor during the dwell period 504 goes more negative for a longer duration than the voltage across the sense resistor during the dwell period shown in FIG. 4. Thus, when voltage across the sense resistor is sampled via the averaging method described in FIG. 4 or when the sense resistor voltage is sampled at a predetermined amount of time 580 beginning after the primary coil begins to charge, a lower voltage across the sense resistor is determined. The voltage across the sense resistor measured at the predetermined time is represented by dot 588. The voltage across the sense resistor takes a longer amount of time to return to near the ground level 550 when soot accumulation increases. The carbonaceous soot acts to decrease the impedance between the spark plug electrodes. The spark plug and sense resistor form a voltage divider. Therefore, when the spark plug resistance changes due to soot accumulation, a different voltage is provided across the sense resistor. The voltage across the sense resistor during the ignition dwell period can be mapped empirically to a soot amount at the spark plug electrodes.

At time $T_2$, current flow through the primary coil ceases and the ignition coil generates a spark at the spark plug electrodes. The spark duration may be measured as time 506 between the time when current ceases to flow into the primary coil and when the voltage across the sense resistor switches from positive to negative. Thus, voltage across sense resistor 310 in FIG. 3 allows both spark duration and carbonaceous soot to be determined.

Referring now to FIG. 6, a flow chart of a method for detecting carbonaceous soot and/or conductive deposits at a spark plug center electrode ceramic and taking mitigating actions is shown. The method of FIG. 6 may be stored as executable instructions in non-transitory memory of controller 12 of FIG. 1. The method of FIG. 6 may provide the signals of FIGS. 4 and 5.

At 602, engine operating conditions are determined. Engine operating conditions may include but are not limited engine speed, engine load, engine temperature, ambient temperature, and battery voltage. Method 600 proceeds to 604 after engine operating conditions are determined.

At 604, method 600 judges whether or not it is desirable to monitor one or more engine spark plugs for conductive deposits and/or spark duration. In one example, conductive deposits may be monitored at lower engine speeds and loads. Conductive deposits may include but are not limited to fuel and carbonaceous soot. If method 600 judges that it is desirable to monitor soot and/or spark duration the answer is yes and method 600 proceeds to 606. Otherwise, the answer is no and method 600 exits.

At 606, method 600 closes a switch and allows current to flow from a battery or alternator to the primary coil of an ignition coil. The switch is closed during a crankshaft interval determined from a table of empirically determined spark timings. In one example, engine speed and engine load index and the table outputs a spark timing referenced to engine crankshaft position. In particular, the spark timing is referenced to top dead center compression stroke of the engine cylinder receiving the spark. Similarly, the duration that the switch is closed, the dwell time, may be based on output from a table that holds spark dwell times as a function of engine speed and load. Additionally, one or more sparks may be initiated by a spark plug during a cylinder cycle. Method 600 proceeds to 608 after the switch is closed and current begins to flow into the ignition coil.

At 608, method 600 waits a threshold amount of time and then samples the voltage across a sense resistor in a circuit as shown in FIG. 3. Method 600 waits a threshold amount of time before sampling voltage across the sense resistor so that any voltage ringing may dampen out before the voltage across the sense resistor is sampled. Method 600 proceeds to 610 after the threshold amount of time expires.

At 610, the voltage across the sense resistor is sampled. The voltage across the sense resistor may be sampled a predetermined number of times as described with regard to FIGS. 4 and 5 during the ignition dwell period, and the average sense voltage may be determined from the samples. In another example, a single sample of sense resistor voltage may be taken each cylinder cycle as shown in FIGS. 4 and 5. Thus, alternative ways of sampling the voltage across the sense resistor are possible. Method 600 proceeds to 612 after the voltage across the sense resistor is sampled and determined.

At 612, method 600 judges whether the sense voltage is greater than a threshold voltage. In one example, the absolute value of the sense voltage may be compared to a predetermined voltage. If the absolute value of the sense voltage is greater than the threshold voltage the answer is yes and it may be determined that more than a threshold amount of soot has accumulated at the spark plug electrodes. Therefore, method 600 proceeds to 614. For example, if the voltage across the sense resistor is determined to be −4 volts, having an absolute value of 4 volts, it may be determined that more than a threshold amount of soot has accumulated at the spark plug electrodes when the threshold voltage is 2 volts. Consequently, method 600 proceeds to 614. If the absolute value of the voltage across the sense resistor is less than the threshold value the answer is no and method 600 proceeds to 616. The soot accumulation flag for the cylinder is cleared when the answer is no.

In other examples where the voltage across the sense resistor is negative, a soot amount accumulated at the spark plug greater than a threshold amount may be determined when voltage across the sense resistor is less than a threshold amount. For example, if voltage across the sense resistor is determined to be −6 volts and the threshold voltage is −5 volts, it may be determined that an amount of soot accumulated at the spark plug is greater than a threshold amount. Therefore, the answer is yes and method 600 proceeds to 614. If the voltage across the sense resistor is greater than the threshold amount (e.g., −4 volts) the answer is no and method 600 proceeds to 616.

At 614, method 600 sets a spark plug soot determination flag and initiates engine control actions to reduce the soot accumulated at the spark plug electrodes. In one example, an air-fuel ratio supplied to the cylinder where soot is detected on the spark plug may be set to a leaner value. Further, temperature in the cylinder may be increased as well as cylinder load so that the accumulated soot may be oxidized. In one example, cylinder load may be increased by applying a load to the engine via an alternator or an electric motor. The engine throttle is opened and additional fuel is injected as the engine load increases, thereby increasing temperature and pressure in the cylinder via increasing the cylinder charge. In other examples, engine load may be increased via up shifting a transmission gear and adjusting the throttle and fuel injection amount. In these ways, temperatures and pressures within the cylinder with soot accumulated at a spark plug can be increased so as to oxidize the soot accumulated at the spark plug. Method 600 proceeds to 616 after the spark plug soot determination flag is set.

At 616, method 600 determines spark duration. The spark duration may be an indication of cylinder misfire. For example, if a short period of time occurs between when current flow to the primary ignition coil ceases and when voltage across the sense resistor transitions from positive to negative, it may be determined that a misfire occurred. The misfire may be related to soot accumulation at the spark plug. In one example, the spark duration is measured from a time when current flow to the primary coil ceases to a time when voltage across the sense resistor changes from positive to negative. Method 600 proceeds to 618 after the spark duration is determined.

At 618, method 600 judges whether or not the spark duration is less than a threshold amount of time. If the spark duration is less than a threshold amount of time, method 600 proceeds to 620. In other examples, method 600 may also proceed to 620 if the spark duration is determined to be greater than a threshold amount of time. A spark duration that is greater than a threshold duration may be indicative of a no spark condition. Thus, if spark duration is within a predetermined range the answer is no and method 600 clears a misfire flag and proceeds to exit. Otherwise, the answer is yes and method 600 proceeds to 620.

At 620, method 600 sets a misfire flag and adjusts engine operation to mitigate the possibility of misfire. In one example, method 600 may increase the dwell time to increases spark energy. In other examples, method 600 may lean a cylinder air-fuel ratio if the cylinder is receiving a rich air-fuel mixture. Alternatively, method 600 may richen a cylinder air-fuel ratio if the cylinder is receiving a lean air-fuel mixture. In these ways, method 600 attempts to mitigate the possibility of engine misfire. Method 600 proceeds to exit after the misfire flag is set and after engine operation is adjusted to mitigate misfire.

As will be appreciated by one of ordinary skill in the art, routines described in FIG. 6 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

Thus, the method of FIG. 6 provides for monitoring a spark plug, comprising: charging an ignition coil supplying electrical energy to the spark plug; and adjusting an engine operation in response to an electrical characteristic of a sense resistor during an ignition dwell period of the ignition coil, the sense resistor being in electrical communication with the ignition coil. The method includes where the ignition dwell period is a time when the ignition coil is charging, where the electrical characteristic is a voltage, and where the sense resistor is in electrical communication with a secondary coil of the ignition coil. Thus, spark plug soot fouling may be detected during an ignition dwell period.

The method also includes where the sense resistor is electrically in series with the ignition coil secondary and the spark plug. The method further comprises determining a spark duration via a voltage of the sense resistor after the ignition dwell period. Additionally, the method further comprises determining an engine misfire in response to the spark duration less than a threshold amount of time. The method also includes where adjusting engine operation includes leaning an air-fuel ratio supplied to the engine. The method further includes where adjusting engine operation includes increasing a load applied to the engine.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, or alternative fuel configurations could use the present description to advantage.

The invention claimed is:

1. A system for monitoring a spark plug, comprising:

an ignition coil including primary and secondary coils;

a spark plug in electrical communication with the secondary coil;

a sense resistor electrically coupled in series with the secondary coil and the spark plug; and a controller including instructions stored in non-transitory memory to adjust operation of an engine responsive to an electrical characteristic of the sense resistor, the electrical characteristic determined during an ignition dwell period, and instructions to determine a cylinder misfire in response to a time being less than a threshold amount of time, the time determined from an end of the ignition dwell period to a transition of a voltage across the sense resistor from a positive voltage to a negative voltage.

2. The system of claim 1, where adjusting operation of the engine includes adjusting an air-fuel mixture of the engine, and where the ignition coil is a positively firing ignition coil, and further comprising instructions for shifting between transmission gears in response to the electrical characteristic.

3. The system of claim 1, where the adjusting operation of the engine includes increasing a load applied to the engine, where the electrical characteristic of the sense resistor is a voltage across the sense resistor, and where the voltage of the sense resistor is inverted.

4. The system of claim 1, further comprising a diode arranged electrically in parallel with the sense resistor and in electrical communication with the sense resistor and the secondary coil.

5. The system of claim 4, where the diode is a zener diode, and where operation of the engine is adjusted in response to a voltage across the sense resistor less than a threshold voltage.

6. The system of claim 1, where the electrical characteristic is a voltage.

7. The system of claim 1, further comprising additional instructions stored in the non-transitory memory to charge the primary coil, and where the ignition dwell period is during charging of the primary coil.

8. A system for monitoring a spark plug, comprising:

an ignition coil including primary and secondary coils;

a spark plug in electrical communication with the secondary coil;

a sense resistor electrically coupled in series with the secondary coil and the spark plug; and a controller including instructions stored in non-transitory memory to adjust operation of an engine in response to an electrical characteristic of the sense resistor, the electrical characteristic determined during an ignition dwell period, and further instructions to adjust operation of the engine in response to a spark duration that is based on the electrical characteristic after the ignition dwell period and additional instructions to determine a cylinder misfire in response to a time being less than a threshold amount of time, the time determined from an end of the ignition dwell period to a transition of a voltage across the sense resistor from a positive voltage to a negative voltage.

9. The system of claim 8, where adjusting operation of the engine in response to the spark duration includes adjusting a cylinder air-fuel ratio, and further comprising instructions for shifting from a first transmission gear to a second transmission gear in response to the electrical characteristic.

10. The system of claim 8, where the electrical characteristic is a voltage across the sense resistor, and further comprising a diode coupled electrically in parallel with the sense resistor.

11. The system of claim 10, where the sense resistor and the diode are electrically coupled to a ground reference, and where the diode is forward biased in a direction of the ground reference during spark.

12. The system of claim 8, where the spark plug and the sense resistor are electrically coupled to opposite ends of the secondary coil.

13. The system of claim 8, where the spark duration is a time from when current flow to the primary coil ceases to a time when the electrical characteristic of the sense resistor after the ignition dwell period switches from a positive value to a negative value.

14. A method for monitoring a spark plug, comprising:

charging an ignition coil supplying electrical energy to the spark plug;

adjusting an engine operation in response to an electrical characteristic of a sense resistor, the electrical characteristic determined during an ignition dwell period of the ignition coil, the sense resistor being in electrical communication with the ignition coil; and adjusting engine operation in response to a cylinder misfire, the cylinder misfire based on a time being less than a threshold amount of time, the time determined from an end of the ignition dwell period to a transition of a voltage across the sense resistor from a positive voltage to a negative voltage.

15. The method of claim 14, where the ignition dwell period is a time when the ignition coil is charging, where the electrical characteristic is a voltage, and where the sense resistor is in electrical communication with a secondary coil of the ignition coil.

16. The method of claim 15, where the sense resistor is electrically in series with the secondary coil and the spark plug.

17. The method of claim 14, where adjusting engine operation in response to the electrical characteristic of the sense resistor includes leaning an air-fuel ratio supplied to an engine.

18. The method of claim 14, where adjusting engine operation in response to the electrical characteristic of the sense resistor includes increasing a load applied to an engine.

* * * * *